US006656388B1

(12) United States Patent
Yang et al.

(10) Patent No.: US 6,656,388 B1
(45) Date of Patent: Dec. 2, 2003

(54) CONDUCTING POLYMERS FOR COATINGS AND ANTIELECTROSTATIC APPLICATIONS

(75) Inventors: Sze C. Yang, Wakefield, RI (US); Huaibing Liu, Kingston, RI (US); Robert L. Clark, Middletown, RI (US)

(73) Assignee: The Board of Governors for Higher Education, State Rhode Island and Providence Plantations, Providence, RI (US)

( * ) Notice: Subject to any disclaimer, the term of this patent is extended or adjusted under 35 U.S.C. 154(b) by 0 days.

(21) Appl. No.: 09/529,836

(22) PCT Filed: Oct. 29, 1998

(86) PCT No.: PCT/US98/23032

§ 371 (c)(1),
(2), (4) Date: Nov. 3, 2000

(87) PCT Pub. No.: WO99/22380

PCT Pub. Date: May 6, 1999

Related U.S. Application Data

(60) Provisional application No. 60/063,766, filed on Oct. 29, 1997.

(51) Int. Cl.[7] ..... H01B 1/12
(52) U.S. Cl. ..... 252/500; 528/422
(58) Field of Search ..... 252/500; 528/422, 528/423, 424

(56) References Cited

U.S. PATENT DOCUMENTS 5,186,860 A * 2/1993 Joyce, Jr. et al. ..... 252/500
5,290,483 A * 3/1994 Kulkarni et al. ..... 252/500
5,489,400 A 2/1996 Liu et al.
6,010,645 A * 1/2000 Angelopoulos et al. ..... 252/500

FOREIGN PATENT DOCUMENTS

JP 63-215722 * 9/1988
JP 01-254764 * 10/1989
JP 02-069525 * 3/1990
JP 05-262981 * 10/1993

OTHER PUBLICATIONS

Liu et al (Novel Colloidal Polyaniline Fibrils Made by Template Guided Chemical Polymerization), J. Chem Soc. Chem. Comm. Nov. 1991 pp151–153.*
Liu et al (Novel Template Guided Synthesis . . . ), Mat. Res. Soc. Symp. Proc. vol 247 (Jan. 1992), pp 601–606.*

* cited by examiner

*Primary Examiner*—Mark Kopec

(57) ABSTRACT

A processable electrically conductive polymeric complex comprising a polyelectrolyte having acid functional groups and a conductive polymer selected from the group consisting of polyaniline, polypyrrole, polythiophene, poly(phenylene sulfide), the conductive polymer ionically bound to the polyelectrolyte. The mole ratio of the monomers which form the conductive polymer to the acid functional groups of the polyelectrolyte is ≧1. The polymeric complex is made by a template-guided chemical polymerization process which comprises adsorbing the monomers onto the polyelectrolyte in a mixture of alcohol and water to form a polyectrolyte adduct, emulsifying the polyelectrolyte adduct in an acid to form an emulsified polyelectrolyte adduct and oxidatively polymerizing the emulsified polyectrolyte adduct. The polymeric complex is water insoluble when dried as a coating on a substrate.

21 Claims, 1 Drawing Sheet

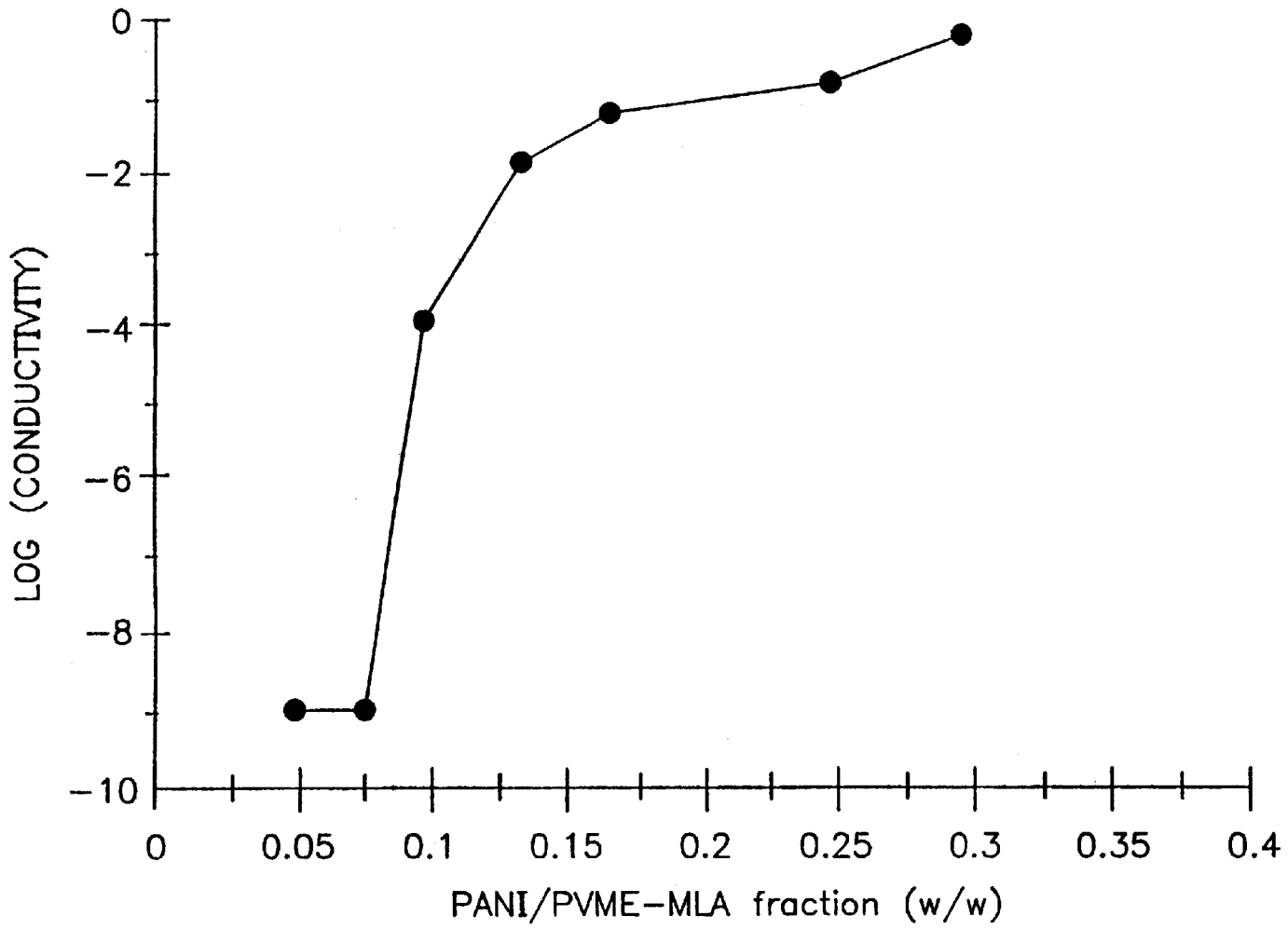
LOG (CONDUCTIVITY)
0
-2
-4
-6
-8
-10
0
0.05
0.1
0.15
0.2
0.25
0.3
0.35
0.4
PANI/PVME-MLA fraction (w/w)

CONDUCTING POLYMERS FOR COATINGS AND ANTIELECTROSTATIC APPLICATIONS

This application claims the benefit of provisional application Ser. No. 60/063,766 filed Oct. 29, 1997.

FIELD OF THE INVENTION

The invention relates to an electrically conductive polymeric complex which can be coated on the surfaces of plastics, metals and fibers, or embodied in other polymeric or inorganic materials.

BACKGROUND AND BRIEF SUMMARY OF THE INVENTION

Electrically conductive coatings are used for no-shock rugs, no-cling fabrics, antielectrostatic coatings for packaging materials, low emissivity garments for better insulation value or infrared camouflage and as antielectrostatic coatings for plastics, glass and other surfaces. The prior art coatings for these purposes are typically ionic conductors or electronic conductors.

Ionic conductors include quaternary ammonium salts and polyelectrolytes. The drawbacks to the effective uses of these conductors are low conductivity and surface resistivities $10^9$ to $10^{13}$ ohm per square. The resistivity is humidity sensitive, such that the ionic conductivity is greatly decreased in dry environments.

Electronic conductors, e.g. carbon fibers and antimony-doped tin oxide mixed in polymeric fibers, perform better than ionic conductors because they can achieve higher conductivity and are not as sensitive to humidity levels. However, electronic conductors result in a material which is stiff, fragile and difficult to process. Further, the electronic conductors are difficult to dye.

Intrinsically conducting polymers are not only useful for antielectrostatic applications, they are potentially useful in other fields. They are potentially useful as anticorrosion coatings because of their electroactive interaction with the metal surface. A coating may be applied to windows of a car or a building to reduce heating by sun light because the polymer is effective to prevent the transmission of the near infrared region of the solar radiation while allowing the visible light to pass through. A coating or a fabric-like material that contains the conducting polymer may modify the emissivity of a warm body (human or a vehicle) to camouflage against the detection of night-vision sensors. A material containing a conducting polymer for these applications needs both to be easily applied as a coating material and to be durable as a coating.

Conducting polymers such as single strand polyaniline, have not enjoyed commercial success. They are brittle, very difficult to process and not stable in the conductive state.

A molecular complex of polyaniline and a polyelectrolyte which is processable, is disclosed in U.S. Pat. No. 5,489,400. As disclosed in this patent, the mole ratio of aniline monomer to the acid functional group (polyelectrolyte) was less than one. When the mole ratio was increased beyond one, the molecular complex become insoluble in solvents and was difficult to use in coating or dying processes. Further, the electrical conductivity of the molecular complex disclosed in that patent diminished when the molecular complex was used in a dye or coating.

The present invention is directed to a polymeric complex of a conducting polymer and a polyelectrolyte where the mole ratio of the conducting polymer to the acid functional groups of the polyelectrolyte is greater or equal to one. The polymeric complex described herein is easily processable for coating and mixing applications.

The invention, in another embodiment, is directed to the method of synthesizing the polymeric complex.

The invention in still another embodiment relates to the coatings and compositions based on the polymeric complex.

The present invention discloses a new processable electrically conducting polymer complex and a synthesis for making the same. These processable complexes comprise certain polyelectrolytes and a conducting polymer. The polymeric complex is made by template guided chemical polymerization and contains a polyelectrolyte and a conducting polymer. The polyelectrolyte carries a net negative electrical charge and the conducting polymer carries a net positive electrical charge. Alternatively, the polyelectrolyte can carry a net negative electrical charge and the conducting polymer is in its non-conductive electrically neutral state. Optionally, the polyelectrolyte carries a net positive electrical charge and said conducing polymer in its nonconductive electrically neutral state. In addition, the polymeric complex of this invention can comprise at least two types of polyelectrolyte and one type of conducting polymer.

The polymeric complex is an electrically conducting complex which is suspendable in water. The complex is easily processed such that it can readily be applied by a coating, brushing, spraying, roller, etc. The polymeric complex is washable whether admixed with other polymers or coated on fabrics or hard surfaces. Alternatively, the molecular complex can be admixed with other materials such as epoxy, poly(vinyl butyreal) and NYLON® as polymer blends.

This invention, in one embodiment, relates to a synthesis that leads to the conducting polymeric complex that is a suspension or dispersion in water or aqueous solution. It is processable as a water-borne coating material. The water-borne conducting polymer is, however, insoluble in water once it is dried as a coating on a substrate. This property makes it advantageous. Although the prior art teaches polymeric complexes can be made soluble in water, so a coating can be also made by evaporation of the water, the coating is not durable because it is easily redissolved by water. The truly water soluble conducting polymers can not be used as antielectrostatic coatings if the surface is to be in contact with water or moisture. The prior art water soluble polyaniline is also not useful as anticorrosion coating materials because of the extensive swelling or dissolution in ambient environment.

In a preferred embodiment, the invention is a double strand conducting polymeric complex. One strand is a conducting polymer, preferably polyaniline, which has high electrical (not ionic) conductivity. The other stand is a polyelectrolyte which provides the sites for functionalities. The polyelectrolyte also provides stability to the conducting polymer, processability to the conducting polymer and maintains the conductivity of the conducting polymer in saline water, moisture and solvents, environments of high temperatures, e.g. 200° C. The mole ratio of the aniline to the functional group is greater than 1:1 and the polymeric complex can be suspended in a water or water/alcohol mixture. The ratio of the aniline to acid functional group can be increased to more than 4:1 while still maintaining the properties of processability.

The polyelectrolyte is selected to provide adhesion to textile fibers either by absorption into the fibers, by chemical binding, or by polymer chain tangling or interlocking with the fibers. The conducting polymer resists water induced protonation and is washable in neutral water. Typically prior art conducting polymers deprotonate in water.

The polymeric complex of the invention is an aqueous based composition and can be applied by painting, spraying, dipping, screen printing or any of the known coating techniques, i.e. roll to roll, doctor blade, etc. The complex is suspended as microaggregates in water and is blendable with other polymers or dyes.

The polymeric complexes disclosed herein have higher electrical conductivity than the molecular complexes of the prior art and are still processable (blendable and dispersible).

BRIEF DESCRIPTION OF THE DRAWING(S)

The FIGURE is a graphical representation of the conductivity achieved with a coating of the invention on a fabric.

As described hereinafter, highly conductive and processable polyaniline is (first strand) achieved by the use of (second-strand) polyelectrolytes not previously used with polyaniline in a polymeric complex.

Synthesis of the molecular polymeric complex of polyaniline:poly (vinylmethylether-co-maleic acid) PANI:P (VME-MA).

The polymeric complexes synthesized in the next six examples represent a class of polymeric complexes of polyaniline and a copolymer that contains carboxylic acid functional groups. A structure of this type of polymeric complex is shown.

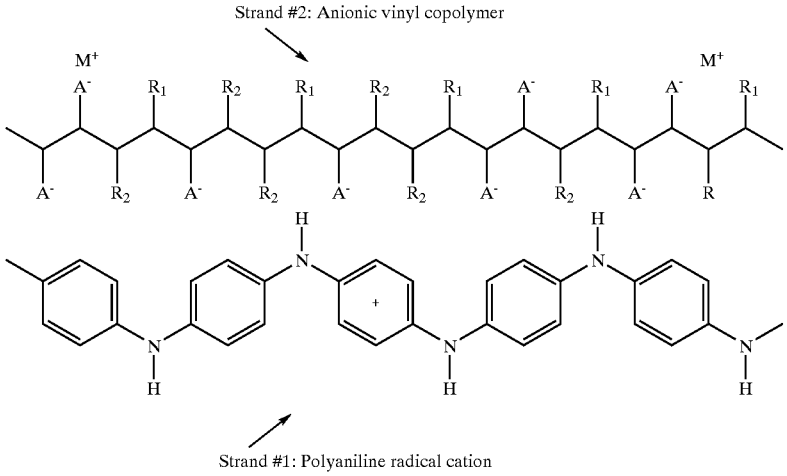

Strand #1 is polyaniline
Strand #2 is poly(methylvinylether-co-maleic acid).
$A^-$ = carboxylate = $COO^-$
$R_1$ = methoxy group = O—$CH_3$
$R_2$ = hydrogen atom = H
$M^+$ = counter ion = $H^+$, $Na^+$, $K^+$, $NH_4^+$ and $H^+N(CH_3)_3$

DESCRIPTION OF THE PREFERRED EMBODIMENT

The polymeric complex embodying the invention comprises a first strand of a conducting polymer and a second strand of a polyelectrolyte.

The first strand is selected from the group consisting of polyaniline, polypyrrole, polythiophene, poly(phenylene sulfide), poly(p-phenylene), poly(carbazole), poly (thienylene vinylene), polyacetylene, poly (isothianaphthene) or the substituted versions thereof.

The second strand polyelectrolytes are selected from the group consisting of poly(acrylic acid) PAA; poly (vinylmethylether-co-maleic acid) (PVME-MA); poly (vinylalkylether-co-maleic acid; poly(ethylene-co-maleic acid); and structurally and functionally equivalent polyelectrolytes.

In the synthesis of the double strand polymeric complex, a mixed solvent system is used which allows a higher conducting monomer to polyelectrolyte mole ratio to be achieved without the reactants and the products (first and second strands) coagulating or precipitating out of the reaction solution.

In the polymeric complex the ratio $r=N_{AN}/N_{—COOH}$ is a variable that can be controlled by the template guided synthesis which is described in the literature and the aforementioned patient. Here $N_{AN}$ is the number of aniline monomer units in the polymeric complex, and $N_{—COOH}$ is the number of the carboxylic functional groups $A^-$ in the same polymeric complex. The r value for the prior art molecular complex was r<1.

The following examples describe the synthesis and the material properties for the molecular complexes where r=1, 2, 3 and 4. These complexes are aqueous-based and the coatings formed are more electrically conductive than the prior art coatings. Furthermore, the coating, after the water is evaporated, is not dissolved or dedoped by contact with water.

EXAMPLE 1

Synthesis of Polyaniline: poly(acrylic acid) complex with $r=N_{AN}/N_{—COOH}=1$, [Polyaniline:poly(acrylic acid), r=1]. Here we use the symbol : to indicate the non-covalent bonding between two polymers. The value of r is included to specify the ratio $N_{AN}/N_{—COOH}$.)

Step 1: Adsorption of aniline onto poly(acrylic acid) to prepare [poly(acrylic acid):(Aniline)$_n$]:

In this step a complex of [poly(acrylic acid):(Aniline)$_n$]: was prepared by adsorbing (or binding) the aniline monomer onto the poly(acrylic acid) in a water/methanol solution. The adsorbed aniline molecules are polymerized later into polyaniline in Step 3.

10 ml of methanol was mixed with 7.208 gm of poly (acrylic acid) aqueous solution (containing 25% of PAA, Polyciences, MW=90,000). Water was added to increase the volume of the solution to 100 ml. This solution was rigorously stirred which a magnetic stirrer for 15 minutes. This solution contained 0.025 moles of poly(acrylic acid). 2.328 g of freshly distilled aniline was slowly added to the poly(acrylic acid) solution under rigorous stirring. An additional 10 ml of methanol was added. Stirring was continued for 30 minutes. The total amounts of aniline equaled 0.025 mole. The mixture had a pH value of about 5.

The following observations are consistent with the formation of polymeric complex between the aniline molecules and the poly(acrylic acid). The viscosity of the solution was significantly increased upon the addition of aniline. The measured increase in intrinsic viscosity is much more than that expected from a simply mixture of aniline and poly (aniline acid). For a simple mixture with no binding between acrylic and the acid, the viscosity should be about equal to the sum of the two components in pH 5 solution. The high viscosity is consistent with the binding of aniline onto the poly(acrylic acid) chain. When aniline is adsorbed onto poly(acrylic acid), the polymer chain is more extended than that of the original in a poly(acrylic acid), random coil, and thus the viscosity is much higher. The aniline molecules can bind to poly(acrylic acid) by hydrogen bonding, or the anilinium ions may be strongly attracted by the electrostatic force form the ionized portion of the poly(acrylic acid). The later electrostatic attraction is known as "counter ion condensation"for polyelectrolytes (Reference: G. Manning, J. Chemical Physics, 89, 3772 (1988), Accounts of Chemical Research, 12, 443 (1979)). The non-covalent binding between the aniline monomers and the poly(acrylic acid) is represented by a color; the symbol for the adduct poly (acrylic acid):(AN)$_n$.

Step 2: Formation of emulsified poly(acrylic acid):(AN)$_n$ adduct.

100 ml of 2 m HCl was added to the poly(acrylic acid):aniline solution. The solution turned milky white immediately due to the scattering of the ambient light by a macro-emulsion of the polymeric complex. (When the solution was continuously stirred vigorously, the intensity of light scattering decreased and the color of the scattered light gradually changed from milky white to nearly transparent with a tint of turbidity. When this faintly turbid solution was examined by illumination with a focused beam of white light (or sun light) and viewed at an angle against a dark background, the scattered light had a blue tint.

The solution initially turns to milky white macro emulsion because the acid added to the solution decreased the degrees of ionization of the poly(acrylic acid):(AN)$_n$ adduct formed in Step 1. The unionized adduct becomes more hydrophobic and folds into particles that contain an interior hydrophobic core that is rich in aniline adsorbed to the poly(acrylic acid). The exterior surface of the particles may be more hydrophilic with some ionized carboxylate groups in contact with the surrounding water molecules. The emulsified particle in this case is likely to be an aggregate of the polymeric adduct poly(acrylic acid):(AN)$_n$ which is hydrophobic if the aniline molecules remain bounded to the poly(acrylic acid) when the hydrochloride acid is added. Immediately after the addition of the hydrochloric acid, the size of the aggregated particle is large, but the aggregate rearrange into smaller particles in the methanol/water solution.

The change in light scattering is consistent with an initial formation of a macro-emulsion that scatters visible light of all colors, and the subsequent transformation into micro emulsion with smaller particle size that scatters only the shorter wavelength region of the visible light. The presence of methanol or other polar organic solvents helps to break the initial macro-emulsion into smaller particles. The small particle is, to some extent, similar to the micro emulsions found in emulsion polymerization for the production of latex (Blackely, D. C., *Emulsion Polymerization,* Wiley, N.Y., 1975; Calvert, K. O., *Polymer Latices and their Applications,* MacMillan, N.Y. (1982)). Unlike the ordinary oil-in-water emulsions, the hydrophobic core in the polymeric complexes prepared is not only a microscopic droplet of aniline, but it is a complex of aniline adsorbed on the poly(acrylic acid) backbone. The poly(acrylic acid):(An)$_n$ adducts may aggregate or fold to form a hydrophobic core, and the ionized carboxylic acid groups are presumbly located at the interface with water. In this emulsified poly (acrylic acid):(An)$_n$ adduct, the poly(acrylic acid) molecule serves two roles: (1) it serves as a template polymer that binds the monomer of the second polymer to form a precursor for the polymeric complex [Polyaniline:poly(acrylic acid), R=1]; and (2) it serves as an emulsifier that helps to absorb the aniline monomers in the interior of the emulsified particle.

Step 3: Polymerization of the emulsified poly(acrylic acid):(An)$_n$ adduct 3 drops of 1 M aqueous ferric chloride ($FeCl_3$ in 2 M hydrochloric acid) were added to the solution prepared in step 2. 3 ml of 30% hydrogen peroxide (0.026 mole of $H_2O_2$ were added to the mixture with constant stirring. The solution immediately turned to a dark green color indicating that the aniline monomers are polymerized into polyaniline. The ferric ion in the solution is a catalyst for the oxidative polymerization. The reaction was essentially completed within 30 minutes. The reaction mixtures were stirred for another 30 minutes before starting the purification steps. The reaction product stayed in the aqueous solution for months with no significant precipitation of the reaction product.

Repeated experiments showed that the use of methanol/water mixed solvent in Step 1 is important. Without an adequate amount of methanol, during the preparation stage of step 1, the final product in step 3 will precipitate either immediately or within a week. With the addition of methanol, ethanol, or some other organic polar solvents, the product of step 3 may be indefinitely suspended in the solution. The polar organic solvent mixture is only needed for the preparation of the micro emulsion of the precursor poly(acrylic acid):(An)$_n$ adduct before the polymerization step, it is not needed for stabilizing the polymerized product. The entire amount of methanol in the reaction product of step 3 can be removed without causing the reaction product [Polyaniline:poly(acrylic acid), r=1] to precipitate.

The methanol was removed by dialyzing against a large volume of water to significantly reduce the concentration of methanol, or by heating the solution to evaporate methanol. The role of methanol might be to reduce the particle size during step 2 so that the polymerized final product is suspendable in water. If step 3 were carried out before the white macro emulsion had enough time to change to the transparent micro emulsion, the reaction produce would not be stably dispersed in water but were precipitate within a day or two. This indicates that the transformation from the macro emulsion to micro emulsion is important to the formation of water-borne polymer complex. In a variation of the above procedure, the methanol was not added in step 1, but was added at the beginning of step 2. This modified procedure also produce water-borne polyaniline complexes that are stable in aqueous solution supporting the theory that the function of methanol is to facilitate the reduction of the particle size of the emulsified precursors.

Experiments showed that it is best to start the polymerization step 3 within a short amount of time (within a few hours) after the white macro emulsion is changed to bluish tinted micro emulsion in step 2. When the solution or step 2 is left for days before carrying out step 3, the reaction product is a precipitate and is mostly chloride doped polyaniline instead of the polyaniline:poly(acrylic acid) complex. This may be due to the extraction of the aniline molecule from the micro emulsion into the aqueous phase to form anilinium ions. The micro emulsion produced in step 2 is probably at a metastable state instead of being in the equilibrium state of the solution.

EXAMPLE 2

Synthesis of Polyaniline: poly(acrylic acid) complex with $r=N_{AN}/N_{-COOH}=1.5$, [Polyaniline:poly(acrylic acid), r=1.5].

In this example, the aniline content is increased to r>1 to obtain stable suspension (or emulsion) in water.

Step 1: Adsorption of aniline onto poly(acrylic acid) to prepare [poly(acrylic acid):$(\text{Aniline})_n$]:

7.208 gm of 25% by weight of poly(acrylic acid) (from Polyciense, MW=90,000) was added to 10 ml of methanol, then water was added to make 100 ml of poly(acrylic acid) solution. This solution was transferred to a round bottom flask with a magnetic stirrer and continuous rigorous stirring was initiated for 15 min. (Total # of moles of carboxylic acid functional groups=0.025 mole).

3.492 gm of freshly distilled aniline was slowly added to the poly(acrylic acid) solution under rigorous stirring. An additional 10 ml of methanol was added. Stirring was continued for an additional 30 minutes. All solid materials were dissolved at this time. (Total amount of aniline equals 0.038 mole). The viscosity of the solution was significantly increased after the addition of aniline.

Step 2: Formation of emulsified poly(acrylic acid):$(\text{An})_n$ adduct 100 ml of 2 M HCl was added to the poly(acrylic acid):aniline solution. A turbid solution was initially formed. The solution was milky white immediately after the addition of the hydrochloric acid due to the scattering of the ambient light by the macro-emulsion of the polymeric complex. When the solution was continuously stirred vigorously, the intensity of light scattering decreases and the color of the scattered light changed from white to transparent with slightly tinted turbidity.

Step 3: Polymerization of the emulsified poly(acrylic acid):$(\text{An})_n$ adduct 3 drops of 1 M aqueous ferric chloride ($FeCl_3$) in 2 M hydrochloric acid was added to the reaction mixture 4.4 ml of 30% hydrogen peroxide (0.039 mole of $H_2O_2$) was added to the reaction mixture with constant stirring for an additional hour. The liquid was dark green in color. The reaction product stayed in the aqueous solution for months with no significant precipitation of the reaction product.

The green-colored aqueous solution contains a stable suspension of the reaction product. The suspension is stable indefinitely. Negligible amount of the product precipitates from the solution on standing for a long period of time. The solution can be filtered through filter papers without significant loss of solid material. When 1 ml of the solution was diluted with slightly acidic distilled water (0.01 M HC) the suspension remained stable. This dilute solution showed scattering of light indicating it was a colloidal suspension.

A contrast can be seen by comparing this solution with a solution fo the polyaniline: poly(styrene sulfonic acid) complex (r=0.5) (see Example 11 below) which shows negligible light scattering at the same concentration. It has previously established that the polyaniline:poly(styrenesulfonic acid) molecular complex is dissolved in water is a true solution.

The suspension remains stable upon heating in a water bath at 70° C. When the water vapor was allowed to escape from the container of the solution, the total volume of the solution was reduced and a high solid content solution was formed. Water-borne suspensions with 30% solid content was found to be stable against precipitation.

The suspension was completely precipitated by addition of an equal volume of acetone. This property is similar to the common water-borne latex paints.

The following test shows that the suspension of [polyaniline:poly(acrylic acid)](r=1.5) has a property similar to a latex suspension which is suspendable in water but is insoluble after it is painted on a surface and then is allowed to dry.

The polymeric complexes (green colored liquids) with solid content ranging from 105 to 30% were painted on glass slides, a sheet of poly(methylmethacrylate), and a coupon of aluminum alloys. The green-colored paint was dried in the air at room temperature. The dried films stay on the surface of the substrates with varying degree of adhesion. These films were immersed in water for 24 hours, the film remained as a solid and showed no sign of being dissolved. A comparative test was performed with a [polyaniline:poly (styrenesulfonic acid), r=0.5] complex (see Example 11) which is a water soluble polymer complex prepared by a method of the prior art. The film coated with [polyaniline:poly(styrenesulfonic acid), r=0.5] complex is completely dissolved in water within 10 minutes. This test shows the utility of the water-borne [polyaniline:poly (acrylic acid), r=1.5]. It can be used as a water-borne coating material, but the dried coating stays permanent and resists wash off by water or other solvents.

The procedure outlines in Examples 1 and 2 may be applied to the synthesis of other polymeric complex of polyaniline to produce latex-like water-borne suspension of the reaction product. The following examples show the synthesis of the molecular complex of [polyaniline:poly (vinlymethylether-co-maleic acid), r=1 to 4] and the analysis of the composition of the reaction products.

EXAMPLE 3

Synthesis of [PAN:PVME-MA, r=1]

1.92 gm of poly(vinylmethylether-co-maleic acid)m, PVME-MA, (containing 0.022 moles of carboxylic functional groups, Aldrich, M.W.=67,000) was dissolved in 25 ml of distilled water. 5 ml of methanol was added and slowly 2 gram of aniline (0.022 mole of aniline) was added to this solution and stirred for one hour. At this stage, aniline was adsorbed on PVME-MA to form the adduct [poly (vinylethylether-co-maleic acid):$(\text{An})_n$.

25 ml 3 M HCl and $6.0\times10^{-4}$ mole of ferric chloride was slowly added to the solution and stirred for 30 minutes. At this stage, the micro emulsion of the adduct [poly (vinlymethylether-co-maleic acid):$(\text{An})_n$] was stabilized to an appropriate size in the acidic solution.

2.5 ml of 3% hydrogen peroxide (containing 0.022 mole H2O2) was added slowly to initiate the polymerization of the adduct of aniline and PVME-MA. The reaction mixture soon become green in color. After vigorous stirring for 2 hours, the reaction mixture was poured through a filter paper to remove a small amount of particles. The filtrate was a dark green homogeneous aqueous dispersion of the reaction product.

The suspension stability: The as-obtained solution remained homogeneous for over one year without precipitation. The dispersed product does not flocculate in salt solutions such as 0.37 M of sodium sulfate indicating good stability against salting out.

The conductivity measurement.

The solution was purified through dialysis to remove unreacted aniline and other small ions. The purified aqueous solution was cast on a glass microslide and dried at 70° C. for 48 hrs. The thickness (t) of the film was estimated through the measurement of absorbance (A) at 800 nm (when A-1, t=1 $\mu$m). Colloidal silver was coated over the cast film to make four contact lines. The conductivity of the cast film was measured through the standard four-probe method. As an example, A=1.1, t=1.1 $\mu$m, the distance d=1.0 cm, the width w=2.5 cm, the resistance $R=1.3\times10^5\Omega$, the conductivity $\sigma$=d/Rtw=0.28S/cm.

The average conductivity value is reported in the Table set forth below.

EXAMPLE 4

PANI:P(VME-MA), r=2

Synthesis of PANI/PVME-MA(—COOH/An=1:2)

0.96 gm of poly(vinylmethylether-co-maleic acid) (containing 0.011 mole of carboxylic functional group Aldrich, M.W.=67,000) was dissolved in 25 ml of distilled water. Then 0.022 mole aniline monomer was added. A white emulsion was formed. 5 ml of methanol was added to make a clear solution and the solution was stirred for 1 hour. 25 ml 3M HCl and $6.0\times10^{-4}$ mole ferric chloride were introduced and then 0.022 mole hydrogen peroxide was slowly added into the reaction mixture. The reaction mixture soon become green colored. After vigorous stirring for 2 hours, the reaction mixture was poured through a filter paper to remove small amount of particles. The filtrate was a dark green homogeneous aqueous solution.

The suspension stability: the as-obtained solution remained homogeneous for over one year. The suspension remains stable when mixed with 0.37M $Na_2SO_4$.

The conductivity measurement

The product solution was purified through dialysis to remove unreacted aniline and other small ions. The purified aqueous solution was cast on a glass microslide and dried at 70° C. for 48 hrs. The thickness (t) of the film was estimated through the measurement of absorbance (A) at 800 nm (when A-1, t=1 $\mu$m). The colloidal silver was coated over the cast film to make four contact lines. The conductivity of the cast film was measured through the standard four-probe method. As an example, A=0.6, t=0.6 $\mu$m, the distance d=1.2 cm, the width w=2.5 cm, the resistance $R=2.1\times10^4\Omega$, the conductivity $\sigma$=d/Rtw=0.038S/cm. The average conductivity value is reported in the Table below.

EXAMPLE 5

PANI:P(VME-MA), r=3

Synthesis of PANI/PVME-MA(—COOH/An=1:3)

0.96 gm of poly(vinylmethylether-co-maleic acid) (containing 0.011 mole of carboxylic functional groups, Aldrich, M.W.=67,000) was dissolved in 25 ml of distilled water. Then 0.033 mole aniline monomer was added and a white emulsion was formed. 10 ml of methanol was added to make a clear solution and the solution was stirred for 1 hour. Then 25 ml 3M HCl and $6.0\times10^{-4}$ mole ferric was added and 0.033 mole hydrogen peroxide was slowly added. The reaction mixture soon became green colored. After vigorous stirring for 3 hours, the reaction mixture was poured through a filter paper to remove small amount of particles. The filtrate was a dark green homogeneous aqueous solution.

The suspension stability

The as-obtained solution remained homogeneous for over one year. The suspension remained stable when mixed with 0.37M $Na_2SO_4$.

The conductivity measurement

The product solution was purified through dialysis to remove unreacted aniline and other small ions. The purified aqueous solution was cast on a glass microslide and dried at 70° C. for 48 hours. The thickness (t) of the film was estimated through the measurement of absorbance (A) at 800 nm (when A-1, t=1 $\mu$m). The colloidal silver was coated over the cast film to make four contact line. The conductivity of the cast film was measured through the standard four-probe method. As an example, A=1.3, t=1.3 $\mu$m, the distance d=1.0 cm, the width w=2.5 cm, the resistance $R=9.0\times10^3\Omega$, the conductivity $\sigma$=d/Rtw=0.034S/cm. The average conductivity value is reported in the Table below.

EXAMPLE 6

PANI:P(VME-MA), r=4

Synthesis of PANI/PVME-MA(—COOH/An=1:4)

0.96 gm of poly(vinylmethylether-co-maleic acid) (containing 0.011 mole of carboxylic functional groups, Aldrich, M.W.=67,000) was dissolved in 25 ml of distilled water. Then 0.044 mole aniline monomer was added and a white emulsion was formed. 12 ml of methanol was added to make a clear solution and the solution was stirred for 1 hour. Then 25 ml 3M HCl and $6.0\times10^{-4}$ mole ferric chloride was added and 0.044 mole hydrogen peroxide was slowly added. The reaction mixture soon became green colored. After vigorous stirring for 4 hours, the reaction mixture was poured through a filter paper to remove appreciable amount of particles. The filtrate was a dark green homogeneous aqueous solution.

The next section describes examples of the chemical analysis of the reaction products to show that the expected $r=N_{AN}/N_{COOH}$ values of the molecular complex are confined. The yield of the reaction was high enough that there was no significant amount of unreacted starting materials remaining in the water suspension of the final product. The chemical analysis of the products formed in Examples 3 and 6 are used as an illustration of the procedure.

Chemical composition of the molecular complex

The following steps were carried out for the chemical analysis:

1. Purify the reaction product to remove any unreacted starting material and any side reaction products. The resulting samples contain only the polymeric complex.
2. Perform elemental analysis on the purified sample to verify that the elemental composition matches with the expected r value.
3. Perform spectroscopic analysis to show the purified sample contains the functional groups expected of the polymeric complex.
4. Examine the physical properties of the purified sample to show that the physical properties are consistent with that of a polymeric complex.

Purification of the product

The product solutions may contain free polyelectrolyte, un-complexed PANI, unreacted aniline, low-molecular weight oligomers and inorganic ions. In order to be certain that all the characterization and elemental analysis are performed on samples free of the above-mentioned impurities, a purification was performed that involved filtration, ion exchange, extraction and dialysis.

1. Removal of uncomplexed polyaniline

The uncomplexed polyaniline is known to aggregate into insoluble particles. If there were significant amount of uncomplexed single-strand polyaniline in the product, the solution would contain insoluble particles. The reaction product was found to be a homogeneous green liquid without any visual evidence of suspended particles or precipitates. When the solution of the product formed in example 3 (or from Example 6) is filtered through a filter paper, there was a negligible amount of solid particles remained in the filter paper indicating that most polyaniline formed is in the polymeric complex. The filtrate is free from uncomplexed single-strand polyaniline, and is used for the next step of purification.

2. Removal of ionic impurities

Ferric and ferrous ions used as catalysts were removed by passing the complex solution through a column of cationic ion exchange resin (AMBERLITE IR-120 H). The effectiveness of this removal process was monitored spectroscopically using potassium thiocyanate as indicator. Before ion exchange the sample has a UV absorption spectrum that shows the characteristic absorption band at 470 nm indicating the presence of ferric thiocyanate. After the ion exchange, the 470 nm absorption band was eliminated indicating that the ferric ions were removed.

Since the solution is acidic, any "free" unreacted anilineor the small molecular weight "free" oligomer of aniline (not bound to the molecular complex) should be in the protated form. These anilinium ions were removed by dialysis against 0.2 M hydrochloric acid solution and then against distilled water. The dialysis membrane SPECTRA/POR has a molecular weight cutoff at 3,500.

3. Removal of free poly(vinylmethylether-co-maleic acid)

The uncomplexed poly(vinyl methyl ether-co-maleic acid), PVME-MA, is separated from the molecular complex by exploiting the difference of solubility of these two polymers in an acetonitrile/water mixture. A solubility test was done to establish the solubility difference. It was found that PVME-MA is soluble in the acetonitrile/water mixture of any proportion, while the [polyaniline:poly (vinylmethylether-co-maleic acid), r=1 to 4] complex is insoluble in pure acetonitrile but is dispersible in a water/acetonitrile mixture that contains less than 75% (by volume) of acetonitrile. The complex precipitates in water mixture with more than 75% of acetonitrile. Thus, the free poly(vinyl methyl ether-co-maleic acid) PVME-MA is extracted by an appropriate water/acetonitrile mixture that extracts PVM-MA but precipitates the polymeric complex.

50 ml of the product aqueous solution three times volume of acetonitrile (150 ml) was added to the aqueous dark green complex solution resulting in a dark green precipitate. The precipitate was filtered. If the precipitate is immediately stirred in water, the complex may be redispersed in water and then reprecipitated with three times volume of acetonitrile. The process of dissolution and precipitation was repeated three times until on vaporation of the filtrate no residue remains in the evaporation dish, and the weight of the dried precipitate remains constant. Sometimes, the precipitate from acetonitrile-water mixture was not redispersible in water. In this case, the solid complex was soaked in the mixed solvent of acetonitrile and water and agitated with a magnetic stirrer. The process of filtration and soaking in fresh mixed solvent of acetonitrile and water (3:1 or 4:1) was repeated four times until no residue is left on evaporation of the filtrate and there is no change of the weight of the dried solid complex.

4. Removal of unreacted aniline and oligomers.

To remove the anilinium ions attached to the complex, the sample is treated with a strong base. Under this condition An is released from the complex.

When an excess amount of 1N NaOH solution is added the green-colored solution turns purpose-colored depotonated form. To remove the released aniline and NaOH, the purple colored solution is dialyzed with a dialysis tube (SPECTRA/POR, molecular weigh cutoff at 3,500) against distilled water. The water outside the dialysis tube is analyzed spectroscopically. At the end of dialysis, the purpose colored solution in the dialysis tube turns blue.

The blue colored solution is treated with 0.2M HCl to change back to green colored protonated form. During the cycle of deprotonation and protonation, the polymer conformation of the molecular complex was significantly changed. This conformational change may lead to the exposure of the aniline oligomers originally held by the molecular complex in its hydrophobic pockets. It was found that a small additional amount of aniline and oligo-aniline was removed by this step. The green solution is then subject to repeated dialysis against water to remove the excess HCl until the water outside the dialysis tube is negative to silver nitrate test, which shows the absence of $Cl^-$ ions. The water is also analyzed spectroscopically and no detectable anilium ions are found.

Compositions Analysis supports the complex formation

The sample purified in the manner described in the preceding section is free from any un-reacted starting materials (aniline and PANI:PVME-MLA), any aniline oligomers, any uncomplexed polyaniline or small ion salts. Samples were dried in oven at 70° C. for 72 hours before sealing in air-tight sample vials. Elemental analyses were performed by M-H-W Laboratories, Phoenix, Ariz. The purified sample form the product of Example 3 has an elemental content of C: 60.15% H: 5.87% and N: 7.39%, giving an empirical formula of $(C_7H_{10}O_5)_{0.50}$: $(C_6H_4NH)_{1.00}$: $H_{1\ldots12}O_{0.65}$ which is consistent with the theoretical formula $(C_7H_{10}O_5)_{0.050}$: $(C_6H_4NH)_{1.00}$: $(H_2O)_2$ for [PANI:PVME-MLA, r=1). Note that each monomer unit of the poly(vinylmethylether-co-maleic acid), or $C_7H_{10}O_5$), contains two carboxylic acid thus the chemical formula is consistent with $r=N_{AN}/N_{_COOH}=1$. The presence water in the elemental analysis result is expected because the polymer is hygroscopic. At the temperature of drying 70° C.) the water molecules bound to the ionic group are not removed. Based on the fact that the average molecular weight of PVME-MLA is 67,000 which consists of about 385 units of (vinyl methyl) ether-maleic acid), this complex has the following formula: $(C_7H_{10}O_5)_{385}$: $(C_6H_4NH)_{770}$. Here we use an average degree of polymerization in this formula. There is a distribution of chain length for both polymer strands.

The purified sample form the product of Example 6 has an elemental content of C: 59.18%, H: 4.16% and N: 9.98%, which is consistent with an empirical formula of $(C_7H_{10}O_5)_{0.13}$: $(C_6H_4NH)_{1.00}$. This empirical formula agrees with what is expected for [PANI:PVME-MLA, r=4]. Based on the fact that the average molecular weight of PVME-MLA is 67,000 which consists of about 385 units of (vinyl methyl ether-maleic acid), this complex has the following formula: $(C_7H_{10}O_5)_{385}$: $(C_6H_4NH)_{2962}$. It is quite likely that the polyaniline component of the complex is not a single polymer chain with a degree of polymerization of 2962, but rather an aggregate of several shorter chains that are collectively complexed with the poly(vinylmethylether-co-maleic acid).

The percentage of hydrogen atom in the polyaniline component in the complex is dependent on the degree of oxidation. A sample with higher degree of oxidation may contain higher percentage of quinone-diimine unit (—Ph—N=Q=N—) which has less hydrogen atoms per unit than an aromatic diamine unit (—Ph—NH—Ph—NH—). Here Q stands for a quinone structure and Ph stands for a phenyl ring. The amount of water molecules bound to the polymer complex is weakly dependent on the extent of drying. Taking these uncertainties into account, the results of the elemental analysis are consistent with the expected chemical composition.

Samples were also synthesized without the complexing polyelectrolyte. This yields the conventional single-strand polyaniline. These samples were also submitted to M-H-W Laboratories for elemental analysis as part of blind tests to check the reliability of the elemental analyses. Elemental analysis of the purified base form of single-strand polyaniline gives C: 76.21%, H: 5.09%, N: 5.81% the corresponding empirical formula if $C_6H_{4.81}N_{1.01}$. The expected formula for the fully reduced polyaniline base is $C_6H_5$ N. However, the stable polyaniline can exist in an oxidized form with variable extent of oxidation. The most oxidized form has the theoretical formula of $C_6H_4N$. The sample of pure poly (methyl vinyl ether-co-maleic acid) was submitted for elemental analysis to give C: 49.61%, H: 5.77% while the theoretical composition is C: 48.26%; H: 5.80%. Thus the elemental analysis result is reliable.

The result of elemental analysis indicates that the synthesized products have chemical composition which is consistent with the formation of the molecular complex with the expected r values.

Infrared analysis of the purified molecular complex

The infrared spectrum of PANI:PVME-MLA shows that the reaction product contains functional groups from both PVME-MLA part (—COOH) and from the polyaniline (C—N and aromatic rings). The band at 1718 $cm^{-1}$ is attributed to the stretch mode of carbonyl group of carboxylic acid on PVME-MLE; a strong band at 1160 $cm^{-1}$, which is characteristic of conducting polyaniline can also be identified. The unusual band around 2360 $cm^{-1}$ is due to $CO_2$ in the air. The bands at 1580 $cm^{-1}$ are attributed to the ring stretching combined with C—N stretching. The band at 1263 $cm^{-1}$ is assigned to C—N stretching mixed with C—H bonding. Thus the IR spectrum clearly shows IR features of a molecular complex, i.e. co-presence of unique features from PVME-MLA and PANI.

Polymeric complex:evidences from the physical properties.

Physical properties of our molecular complex are expected to be different from the single-strand polyaniline. WE synthesize both the complex and the single strand PANI under the same reaction condition and examine their difference in properties. To demonstrate that two different products are formed, one from the unusual aniline chemical polymerization and the other from the template-guided aniline polymerization in the presence of maleic acid copolymers, two parallel polyaniline syntheses are run, in which the synthetic conditions and all the reagents are identical except the absence of presence of maleic acid copolymers.

Comparison with the prior art polyaniline:HCl salt

The following Examples compare the properties of the polymeric complexes of examples 1–6 with the prior art molecular complexes (polyaniline:HCl salt).

EXAMPLE 7

Synthesis of single stranded (chloride doped) polyaniline 0.011 mole aniline monomer (Aldrich, redistilled) was added to 50 ml 1.5 M HCl. Subsequently, $6.0\times10^{-4}$ mole ferric chloride was added followed by 0.011 mole hydrogen peroxide (30%, Fisher Scientific). The reaction mixture soon became green-colored and dark-green solid particles precipitated. After continued stirring for two hours, a dark green precipitate was deposited on the bottom with the supernatant liquid being brownish red.

Comparison 1

Different properties of single-stranded polyaniline (Example 7) and the polymeric complexes synthesized in Examples 1 to 6:

The most apparent and striking different between Polyaniline synthesized by the conventional method (Example 7, yields strand PAN;HCl) and by the method described in Examples 1–6 (yielding double-strand polyaniline) is that their solubility (or dispersibility) in aqueous solutions. the double-strand [PAN:PAA, r=1 or 1.5] and [PAN:PVME-MA] are stable emulsions in water, but the single PAN:HCl is insoluble in water. In addition, the double strand polyanilines are more resistant to dedoping by either heat or water. The single-strand PAN:HCl dedopes easily by heating or immersion in pH neutral water.

Comparison with the prior art molecular complexes.

The r ratio of he prior art molecular complex was limited to $r\leqq1$.

The preceding Examples 1–6 show materials where r=1, 2, 3 and 4. This range of ratios has not been reported previously. This range of ratios is advangeous because the materials with higher r values are materials with higher electrical conductivity. The reaction products of Examples 1–6 are stable in aqueous solution. The water-borne high-conductivity materials of the invention have advantageous over the traditional polyaniline:HCl material due to its processability in coating and dyeing applications.

If the r value is increased beyond 1 for the molecular complexes and using the syntheses disclosed in the prior art, the resulting product is not stable in aqueous solution or conventional solvents. Examples 1–6 support that the polymeric complexes of the present invention can have a high r value while being stable in an aqueous medium.

The water-borne molecular complexes with $r\leqq1$ of this invention are synthesized by a procedure that is not obvious in view of the prior art of U.S. Pat. No. 5,489,400. In the synthesis of Examples 1–6, the polyelectrolyte functions not only as a template for binding the monomers of aniline, but also serves as an emulsifier for the adduct polyelectrolyte:) $An)_n$. The formation of the emulsified adduct polyelectrolyte:$(An)_n$ is, however, not the only requirement. In order for the polymerized product [polyaniline:polyelectrolyte, $r\geqq1$] to be stabely suspended in water, the particle size of the emulsified adduct polyelectrolyte:$(An)_n$ needs to be sufficiently small. Examples 1–6 show that the use of methanol-water mixed solvent leads to the product [polyaniline:polyelectrolyte, $r\geqq1$] which is a stable, latex-like, water-borne suspension. We theorize that the methanol contained in the water solution helps to reduced the size of the macro-emulsion of the precursor polyelectrolyte: $(An)_n$ as evidenced form th change of light scattering of the solution from white color to nearly transparent. The utilization of the mixed water-methanol solution is a simple, but subtle, manipulation described in the steps 1 and 2 of Example 1.

In the following examples synthesis (referred to as Procedure B) is substantially similar to that described in Examples 1–6 (which will be referred to as Procedure A) except neglecting the addition of methanol and the associated controls of the emulsion. These examples show that although Procedure B may sometimes lead to water soluble reactions products for r≧1, unlike that of Procedure A, the products always precipitates out of the solution if r≧1.

Comparison 2: Properties of the polymeric complexes synthesized by Procedure B

This comparison experiment was performed in parallel with the experiments described in comparison #1 and Examples 1–6. The concentrations, the volumes of all chemicals used were the same except that the amount (moles) of different polyelectrolytes (templates) were varied for these comparative syntheses. The polyelectrolytes used for the comparisons were poly(acrylic acid) (PAA) and poly(styrene sulfonic acid) (PSSA).

EXAMPLE 8

Synthesis of [PANI;PAA, r=0.5] by Procedure B 1 gram (0.011 mole) of aniline monomer was added to an aqueous solution of poly(acrylic acid) (Aldrich, M.W.=90,000 25 wt. % solution in water) containing 0.022 mole of carboxylic acid functional groups to provide a white gel. The white gel was dissolved in 25 ml of distilled water and to form a homogeneous solution which was stirred for 2 hours. 25 ml of 3M HCl and $6.0\times10^{-4}$ mole ferric chloride was added followed by the slow addition of 0.011 mole of hydrogen peroxide. The reaction mixture soon became green colored. After vigorous stirring for 2 hours, the reaction mixture was poured through a filter paper. The filtrate was a dark green homogeneous aqueous solution. Note that this produce has a r value of 0.5 and is suspendable in water.

EXAMPLE 9

Synthesis of [PANI:PAA, r=1] by Procedure B 0.022 mole of aniline monomer was added to an aqueous solution of poly(acrylic acid) (Aldrich, M.W.=90,000 25 wt. % solution in water) containing 0.022 mole of carboxylic acid functional groups to provide a white gel. The white gel was dissolved in 25 ml of distilled water and this homogeneous solution was stirred for 2 hours. 25 ml of 3M HCl and $6.0\times10^{-4}$ mole ferric chloride was added followed by the slow addition of 0.022 mole of hydrogen peroxide. The reaction mixture soon become green colored. After vigorous stirring for 2 hours, a dark green precipitate formed with the supernatant liquid being brownish red.

This produce with r=1 is not suspendable in water. This is in contrast with the water-borne product of Example 1.

EXAMPLE 10

Synthesis of [PANI:PAA, r=2] by Procedure B 0.022 mole of aniline monomer was added to an aqueous solution of poly(acrylic acid) (Aldrich, M.W.=90,000 25 wt. % solution in water) containing 0.011 mole of carboxylic acid functional groups to provide a white emulsion. 5 ml of methanol was added to make a clear solution and this homogeneous solution was stirred for 2 hours. 25 ml of 3M HCl and $6.0\times10^{-4}$ mole ferric chloride was added followed by the slow addition of 0.022 mole of hydrogen peroxide. The reaction mixture soon became green colored. After vigorous stirring for 2 hours, a dark green precipitate formed with the supernatant liquid being brownish red.

EXAMPLE 11

Synthesis of [PANI:PSSA, r=0.5] by Procedure B.

0.011 mole of aniline monomer was added to an aqueous solution of poly(styrene-sulfonic acid) (Polysciences, M.W.=70,000 30 wt. % solution in water) containing 0.022 mole of sulfonic acid functional groups to provide a white gel. The white gel was dissolved in 25 ml of distilled water and this homogeneous solution was stirred for 2 hours. 25 ml of 3M HCl and $6.0\times10^{-4}$ mole ferric chloride was added followed by the slow addition of 0.011 mole of hydrogen peroxide. The reaction mixture soon become green colored. After vigorous stirring for 2 hours, the reaction mixture was poured through a filter paper to remove small amount of particles. The filtrate was a dark green homogeneous aqueous solution.

EXAMPLE 12

Synthesis of [PANI:PSSA, r=1.0] by Procedure B 0.022 mole of aniline monomer was added to an aqueous solution of poly(styrene-sulfonic acid) (Polysciences, M.W.=70,000 30 wt. % solution in water) containing 0.022 mole of sulfonic acid functional groups to provide a white gel. The white gel was dissolved in 25 ml of distilled water and this homogeneous solution was stirred for 2 hours. 25 ml of 3M HCl and $6.0\times10^{-4}$ mole ferric chloride was added followed by the slow addition of 0.022 mole of hydrogen peroxide. The reaction mixture soon became green colored. After vigorous stirring for 2 hours, a dark green precipitate formed with the supernatant liquid being brownish red.

EXAMPLE 13

Synthesis of [PANI:PSSA, r=1] by Procedure B.

0.022 mole of aniline monomer was added to an aqueous solution of poly(styrene-sulfonic acid) (Polysciences, M.W.=70,000 30 wt. % solution in water) containing 0.011 mole of sulfonic acid functional groups to provide a white emulsion. 5 ml of methanol was added to make a clear solution and this homogeneous solution was stirred for 2 hours. After 25 ml of 3M HCl and $6.0\times10^{-4}$ mole ferric chloride was added followed by the slow addition of 0.022 mole of hydrogen peroxide. The reaction mixture soon became green colored. After vigorous stirring for 2 hours, a dark green precipitate formed with the supernatant liquid being brownish red.

Properties of the reaction products synthesized by Procedure B

Although the complexes with low loading of aniline (r<1) is soluble, but functional groups to aniline units) are substantially the same, it is quite different when the aniline loading is high.

The properties of the conducting polymers synthesized in Examples 1–13 are summarized in the followings:

[PAN:PVME-MA, r=1 to 4 ] synthesized by Procedure A is a stable emulsion in water. A coating formed by drying the emulsion is not redissolved in water. It can be used as a water-borne coating material.

[PAN:PAA, r=1 to 1.5] synthesized by Procedure A is a stable emulsion in water. A coating formed by drying the emulsion into a film. The film is not redissolvable in water. It can be used as a water-borne coating material.

[PAN:PAA, r=0.5] and [PAN:PSSA, r=0.5] synthesized by either Procedure A or B are soluble in water. A coating formed by drying the solution does not stay as a coating when immersed in water. It swells and is partially redispersed in water. These materials will not form a durable coating in contact with water or moisture.

[PAN:PAA, r≦1] and [PAN:PSSA, r≦1] synthesized by Procedure B is not a stable emulsion or a solution in water. It can be used as a water-borne coating material.

The single strand PAN:HCl is not soluble or dispersible in water. It can not be used as a water-borne coating material.

From these data on the material properties, it can be seen that only Procedure A leads to superior water-borne conducting polymers that are suitable for coating applications. The product, when synthesized by Procedure A, is a stable emulsion. The dried film formed after coating is not attacked by water or moisture.

The utility of the products synthesized by Procedure A are not limited to water-borne coating applications. Some of the products are soluble in organic polar solvents or water/solvent mixtures for non-aqueous coating applications. The products may also be blended with other polymers such as Nylon 6-12, Nylon 6-6, poly(vinyl butyral), epoxy, alkyd, etc. for various antielectrostatic, anticorrosion and optical applications.

Conductivity Difference

TABLE

| r value | 0.5 | 1 | 2 | 3 | 4 | 5 |
|---|---|---|---|---|---|---|
| PAN:P(MVE-MA) | $10^{-7}$ S/cm | 0.2 S/cm | 0.2 S/cm | 0.1 S/cm | 1 S/cm | 1 S/cm |
| PAN:PAA | $10^{-7}$ S/cm | 0.2 S/cm | 0.2 S/cm | 0.1 S/cm | 1 S/cm | 1 S/cm |

| Conductive polymers | Surface resistivity on thin films Thickness = $10^{-3}$ cm |
|---|---|
| PAN:P(MVE-MA), r = 0.5 | $10^{10}$ Ohm/□ |
| PAN:P(MVE-MA), r = 1 | $5 \times 10^{3}$ Ohm/□ |
| PAN:P(MVE-MA), r = 3 | $10^{4}$ Ohm/□ |

High r-value material obtained by synthesis.

To synthesize PANI/PVME-MA with the mole of ratio of acidic functional groups to aniline monomers 1:2, 1:3, or 1:4 a mixed solvent of methanol and water is used to provide a homogeneous reaction mixture. The polymerization of aniline in the mixed solvent of methanol and water proceeds smoothly as long as the content of methanol is lower than 50%. When the percentage of methanol is greater than 90%, no aniline is polymerized.

In the preferred embodiment of the invention, a conducting polymer is polyaniline and the polyelectrolyte is an anionic copolymer. Polyaniline carries the electrical or optical properties and the anionic copolymer is used as a vehicle to optimize structural features that are needed for processability and durability. The anionic copolymers preferably used include random copolymers, poly(acrylamide-co-acrylic acid) (PAAM-PAA) with acrylic acid contents of 90%, 70%, 40% and 10%, and alternating copolymers, i.e. poly(ethylene-co-maleic acid) (PE-MLA) and poly (vinylmethylether-co-maleic acid) (PVM-MLA).

EXAMPLE 14

Materials

PANI/P(VME-MLA) (An/—COOH=2:1) was synthesized following the procedure previously described for Example 4. Nylon 6/12 and nylon fabrics were obtained from Monsanto.

Measurements

UV-visible spectra were obtained on PERKIN-ELMER Lambda 2 UV/VIS Spectrophotomer.

The conductivity of nylon fabrics and solid cast films on glass strip was measured through a modified 4-probe method. Four silver lines were made equally spaced on the film using a conductive colloidal silver paste. Current (measured by Keithley 197A autoranging microvolt DMM) was passed through two inner silver lines while the voltage drop was measured across two outer silver lines with Potentiostat/Galvanostat HA-151.

A piece of white nylon fabric, commonly used for clothings, was soaked in the aqueous dispersion of PANI/PVME-MLA for 20 minutes, taken out of the solution, rinsed with distilled water and air-dried. This process was repeated twice and uniform green colors fabrics are obtained.

No visible solid particles were deposited on the surface. The fabric was still soft and flexible and no changes in any mechanical properties of the fabric were observed. The surface resistivity of the dyed nylon fabrics were measured as low as $5\times10^{3}$ ohm/square, much lower than $10^{9}$ ohm/square which is the surface resistivity of state-of-the-art antielectrostatic coating.

This piece-dyeing process just described did not provide a complete penetration of PAN:PVME-MA into the fabric. However, it was industrially feasible process to deposit a uniform, smooth, coherent film of the conductive polymer onto individual fibers of the nylon fabric. The film was resistant against water washing cycles and no decrease of conductivity was found with repeated washings. This supports that the PANI/PVME-MLA adheres strongly to the nylon fabric most likely due to hydrogen bonding between PVME-MLA strand and the nylon.

The fact that the connectivity of dyed fabric remain unchanged after repeated water washings also means that this fabric is more resistant against deprotonation induced transition from conductive state to insulating state. Single strand conventional polyaniline changes from conductive state to insulating state at pH around 4 while PANI/PVME-MLA remains conductive until the pH is around 8.5.

The conductivity of the dyed fabrics is less sensitive to humidity than the usual ionic antielectrostatic coatings because conducting polymers are electronic conductors. Although higher humidity leads to higher conductivity, the conductivity of conducting polymer does not rely on the humidity.

The low r value polymeric complexes synthesized by Procedure B in Example 8 for [PAN:PAA, r=0.5] and Example 11 for [PAN:PSSA, r=0.5] were also used as a dyeing agent for comparison purpose. It was found that the stained fabrics when dried, have low conductivity because of the low r values. It was also found that the dyes with r=0.5 are easily redissolved in water and is lost by washing the fabrics.

Electrically conductive polymer blend of PAN:PVME-MLA with Nylon

Nylon 6/12 is readily dissolved in formic acid to give a colorless homogeneous solution. The as-synthesized PANI/PVME-MLA is in aqueous solution. PANI/PVME-MLA as dried powder in a formic acid solution is mixed with concentrated nylon 6/12 formic acid solution (18.2% wt) and dark green fine particles appear, indicating the thermodynamic incompatibility of PANI/PVME-MLA with nylon 6/12. When 4.0% by weight PANI/PVME-MLA is mixed with 1.8% by weight nylon 6/12 in formic acid (based on total weight of solution) a homogeneous solution is obtained. However, the cast film from the above solution is macroscopically inhomogeneous.

A formic acid blend solution (with fine dark green particles) of nylon 6/12 and PANI/PVME-MLA is precipitated when added to water. The distilled blend dissolves in formic acid very readily. After stirring for 72 hours, a dark green homogeneous solution is obtained. The cast film of the solution on glass is very homogeneous and transparent. The reason for the formation of at least macroscopically homogeneous blend is not completely understood. It is speculated that PANI/PVME-MLA may more or less associate or even form a three-component complex nylon 6/12.

The FIGURE shows the electrical conductivity ($\sigma$) versus weight fraction (f) of the PANI/PVME-MLA complex in polyblends with nylon 6/12. The conductivity, rather than being a linear function of loading, rises dramatically as the percolation threshold (f=0.1) is reached. The conductivity at=30% loading is essentially the same as that of the pure PANI/PVME-MLA.

When an electrically conducting material-metal or carbon powder or filaments are mixed with an insulating polymer, essentially no increase in conductivity is observed until particles of the conducting material first touch each other and thus form a conducting pathway throughout the mixture. At this loading level "percolation threshold" (=16 vol. % for a three-dimension network of conducting globular aggregates in an insulating matrix) the conductivity increases extremely rapidly. The percolation threshold is greatly dependent on the size and aspect ratio of the particles-whether, for example, spheres or long needles-and can vary from a few volume percent up to 30% to 40% or more in industrial composites depending on the efficiency of mixing and uniformity of size. However, in blends of doped polyaniline and also in blends of derivatives of certain substituted polythiophenes in conventional insulating polymers either no or only very low (<5%) percolation thresholds are observed.

The relatively large percolation threshold observed with the blend of PANI/PVME-MLA with nylon 6/12 can be explained in terms of wettability or compatibility. The surface tension difference between two components is small or the two components are quite compatible so that PAN:PVME-MA tends to distribute itself homogeneously in nylon 6/12 matrix. Compared with aggregation of the conductive fillers in insulating matrix, the even distribution leads to lower conductivity and higher percolation threshold since the former will afford many more interparticle contacts.

Conductive blends of PAN:PVME-MA and nylon 6/12

The fundamental requirement for creating conducting polyblends is the need for a solvent in which both the conducting polyaniline complex and the desired bulk polymer are co-soluble. Given such a solvent, conducting polyblends can be made by co-dissolving the polyaniline complex and the bulk polymer at concentration such that when cast from solution, the resulting blend will have the desired ratio of conducting polyaniline complex to bulk polymer. The conducting polyblend material can be fabricated into useful shapes (film, fiber, etc.) through standard methods for solution processing (e.g., fiber-sprinning, spin-casting, dip-coating, etc.). In addition, since polyaniline is relatively stable at high temperatures, the conducting polyblends can be melt-processed.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A processable electrically conductive polymeric complex, the polymeric complex being water-borne and comprising a polyelectrolyte having acid functional groups and a conductive polymer, the conductive polymer selected from the group consisting of polyaniline, polypyrrole, polythiophene, poly(phenylene sulfide), the conductive polymer ionically bound to the polyelectrolyte and wherein the mole ratio of the monomers which form the conductive polymer to the acid functional groups of the polyelectrolyte is $\geqq 1$, the polymeric complex being made by a template-guided chemical polymerization process comprising adsorbing the monomers onto the polyelectrolyte in a mixture of alcohol and water to form a polyelectrolyte adduct, emulsifying the polyelectrolyte adduct in an acid to form an emulsified polyelectrolyte adduct and oxidatively polymerizing the emulsified polyelectrolyte adduct to form the polymeric complex, the polymeric complex being water insoluble when dried as a coating on a substrate.

2. The polymeric complex of claim 1 wherein the alcohol is methanol and the substrate is glass.

3. The polymeric complex of claim 1 wherein the polyelectrolyte is selected from the group consisting of poly (acrylic acid) (PAA), poly(vinylmethylether-co-maleic acd) (PVME-MA), poly(vinylalkylether-co-maleic acid) and poly (ethylene-co-maleic acid).

4. The polymeric complex of claim 1 wherein the conductive polymer is polyaniline and the polyelectrolyte is poly(vinylmethylether-co-maleic acid).

5. The polymeric complex of claim 1 wherein the mole ratio of the monomers to the financial groups is 1.

6. The polymeric complex of claim 1 wherein the mole ratio of the monomers to the functional groups is 1.5.

7. The polymeric complex of claim 1 wherein the mole ratio of the monomers to the functional groups is 2.

8. The polymeric complex of claim 1 wherein the mole ratio of the monomers to the functional groups is 3.

9. The polymeric complex of claim 1 wherein the mole ratio of the monomers to the functional groups is 4.

10. The polymeric complex of claim 1 wherein the polyelectrolyte is an anionic copolymer.

11. An electrically conducting fabric comprising a polymeric complex admixed with fibrous material comprised of fibers, the polymeric complex being water-borne and comprising a polyelectrolyte having acid functional groups and a conductive polymer selected from the group consisting of polyaniline, polypyrrole, polythiophene, poly(phenylene sulfide), the conductive polymer ionically bound to the polyelectrolyte and wherein the mole ratio of the monomers which form the conducting polymer to the acid functional groups of the polyelectrolyte is $\geqq 1$, the polymeric complex admixed with fibers selected from the group consisting of Nylon 6-12, Nylon 6-6, poly(vinyl butyral), epoxy and alkyd in an amount of up to 16% percolation threshold by volume based on the total volume of the electrically conductive fabric, the polymeric complex being made by a template-guided chemical polymerization process comprising adsorbing the monomers onto the polyelectrolyte in a mixture of alcohol and water to form a polyelectrolyte adduct, emulsifying the polyelectrolyte adduct in an acid to form an emulsified polyelectrolyte adduct and oxidatively polymerizing the emulsified polyectrolyte adduct, the polymeric complex being water insoluble when dried as a coating on the fibrous material.

12. The polymeric complex of claim 11 wherein the alcohol is methanol.

13. The polymeric complex of claim 11 wherein the polymeric complex is insoluble in water when admixed with the fibers and dried.

14. The polymeric complex of claim 11 wherein the polyelectrolyte is selected from the group consisting of poly(acrylic acid) (PAA), poly(vinylmethylether-co-maleic acid)(PVME-MA), poly(vinylalkylether-co-maleic acid) and poly (ethylene-co-maleic acid).

15. The polymeric complex of claim 11 wherein the conductive polymer is polyaniline and the polyelectrolyte is poly (vinylmethylether-co-maleic acid).

16. The polymeric complex of claim 11 wherein the mole ratio of the monomers to the functional groups is 1.

17. The polymeric complex of claim 11 wherein the mole ratio of the monomers to the functional groups is 1.5.

18. The polymeric complex of claim 11 wherein the mole ratio of the monomers to the functional group is 2.

19. The polymeric complex of claim 11 wherein the mole ratio of the monomers to the functional groups is 3.

20. The polymeric complex of claim 11 wherein the mole ratio of the monomers to the functional groups is 4.

21. The polymeric complex of claim 11 wherein the polyelectrolyte is an anionic copolymer.

* * * * *